United States Patent [19]

Ensor et al.

[11] Patent Number: 4,533,468

[45] Date of Patent: Aug. 6, 1985

[54] CENTRIFUGAL SEPARATION METHOD AND APPARATUS

[75] Inventors: Paul M. D. Ensor, Maida Vale; Neville C. Bassett, Kensington, both of Australia

[73] Assignee: The Broken Hill Proprietary Company Limited, Melbourne, Australia

[21] Appl. No.: 558,463

[22] Filed: Dec. 6, 1983

[30] Foreign Application Priority Data

Dec. 6, 1982 [AU] Australia ..... PF7137

[51] Int. Cl.[3] ..... B04B 1/14

[52] U.S. Cl. ..... 209/172; 209/199; 210/787; 210/512.3

[58] Field of Search ..... 209/172, 199; 210/787, 210/789, 512.3

[56] References Cited

U.S. PATENT DOCUMENTS

| | | | |
|---|---|---|---|
| 489,101 | 1/1893 | Seymour | 209/199 |
| 1,373,219 | 3/1921 | Beach | 209/172 |
| 1,423,169 | 7/1922 | Thayer | 209/199 |
| 1,951,108 | 3/1934 | Reilly | 209/199 |
| 2,004,939 | 6/1935 | Giraud | 494/27 |
| 2,217,062 | 10/1940 | Lewis | 209/199 |
| 2,279,473 | 4/1942 | Limpp | 209/199 |
| 2,538,870 | 1/1951 | Hunter | 209/172 |
| 2,743,815 | 9/1952 | Goodwin | 209/211 |
| 2,893,557 | 7/1959 | Teuteberg | 209/211 |
| 3,392,828 | 7/1968 | Muller | 209/172 |
| 3,407,934 | 10/1968 | Ejefors | 210/787 |
| 4,151,844 | 5/1979 | Cullis et al. | 210/789 |
| 4,443,331 | 4/1984 | Amand | 209/211 |

FOREIGN PATENT DOCUMENTS

| | | | |
|---|---|---|---|
| 462945 | 1/1974 | Australia . | |
| 539340 | 4/1957 | Canada | 210/512.3 |
| 569551 | 1/1959 | Canada | 210/512.3 |
| 971643 | 2/1959 | Fed. Rep. of Germany . | |
| 362127 | 12/1931 | United Kingdom . | |
| 759393 | 10/1956 | United Kingdom | 210/172 |
| 1589389 | 5/1981 | United Kingdom . | |

*Primary Examiner*—Tim Miles

*Attorney, Agent, or Firm*—Murray, Whisenhunt and Ferguson

[57] ABSTRACT

A method of separating lighter and heavier particles in a solids mixture includes entraining the mixture in a liquid of a specific gravity intermediate the specific gravities of the lighter and heavier particles, and feeding the liquid through a first opening into one end of a rotating vessel. The vessel is designed so that the liquid attains a dynamic equilibrium at which an annular, centrifugally-induced, substantially static, revolving volume of the liquid of stable internal surface is confined by the vessel about the axis of rotation, while further liquid flows on within the stable internal surface. Heavier particles are centrifugally directed into the annular volume, while lighter particles remain entrained in on-flowing liquid which flows out a second opening in the other end of the vessel. When liquid feed is discontinued, and the rotating vessel slowed and stopped to release the annular volume of liquid, the liquid swirls towards and flows through one of the openings with the entrained heavier particles. Suitable apparatus includes bearing means to support the vessel for rotation about the axis of rotation, which passes through or near the openings, and a vessel having a smooth continuous interior surface, free of negative slopes, edges or bends whereby sufficient swirling liquid cleans the whole interior surface of heavier particles.

36 Claims, 6 Drawing Figures

CENTRIFUGAL SEPARATION METHOD AND APPARATUS

This invention relates to the separation out of one of more components entrained in a liquid. The invention has particular, although not of course exclusive, application to the separation of heavier and lighter particles where very low particle concentration is being sought and where it is therefore essential to collect substantially all of at least one of the sets of particles.

An essential step in the analysis of stream sediment samples for traces of kimberlitic indicator minerals is the removal of quartz from a heavy mineral concentrate. The traditional method of removing quartz has been to immerse the sample in a liquid of high specific gravity, e.g. tetrabromoethane (TBE), in a separating funnel so that the quartz will float while the heavy minerals sink. However, this process entails batches of typically 100 gms which must be left to separate for at least 2 minutes before the floats and/or sinks may be removed and a fresh sample introduced. The process is thus tedious and time consuming and, in a typical laboratory installation, necessitates multiple samples being treated in funnels simultaneously, usually with several operators. This introduces a risk of cross contamination between samples and confusion as to which concentrate belongs to which sample. The process is also susceptible to operator error, since insufficient settling time may result in the presence of heavy grains in the floats, while an excessive sample may lead to light grains in the sinks. Once separated from the quartz, the heavy mineral concentrate is then usually microscopically checked grain by grain to identify any grains of indicator minerals that may be present.

The difficulty with mechanising the quartz removal process is the extremely low incidence of kimberlitic indicator mineral grains. It would be considered good to find one indicator grain in 100 samples, which represents a detection level of about one part in 2,000,000,000. Thus it is desirable that any separation process permits, first, as thorough as possible a separation of quartz from grains of heavy mineral concentrate and, secondly, every single heavy grain to be cleaned from the device and recovered for identification. It is particularly important that there be no carry over of even a single grain of indicator mineral to the following sample as this would most likely lead to not only failure to recognize the sample which actually contained the indicator but also result in very expensive resampling and analyses from the geographical area corresponding to the contaminated sample.

For these and other reasons, it has been found that the quartz removal step cannot be satisfactorily performed with any existing commercial centrifuge, nor with elutriating columns, cyclones or dynawhirlpools. Commercial bowl centrifuges generally have the floats outlet at the top of the bowl. In order to clean the bowl between samples, the bowl, or a rubber liner, must be removed and inverted. Moreover, a special outer container is necessary to catch the liquid and floats flung from the outlet rim.

It is therefore an object of the invention to provide an improved centrifugal separation process and an associated centrifuge apparatus which permits speedier, more efficient performance with due regard to the requirement of a very low detection limit in subsequent analysis.

The invention accordingly provides, in one aspect, a method of separating out a component entrained in a liquid, comprising:

continuously feeding the liquid through a first opening into one end of a vessel and revolving the liquid therein by rotating the vessel, the vessel being designed so that the liquid attains a dynamic equilibrium at which an annular, centrifugally induced, substantially static revolving volume of the liquid of stable internal surface is confined by the vessel about the axis of revolution while further liquid flows on within said stable internal surface, whereby the entrained component to be separated is centrifugally directed into said annular volume of the liquid while liquid substantially clarified of such component flows on within said internal surface and out a second opening in the other end of the vessel; and discontinuing said feeding of the liquid, slowing and stopping the rotating vessel to release said annular volume of the liquid, which then, with the entrained component, swirls towards and flows through one of said openings.

By "substantially static volume" in the context of this specification is meant a volume that substantially does not exchange liquid with the on-flowing liquid which continues to pass through the vessel.

The component may be particulate or a second liquid heavier than the entraining liquid, e.g. oil in water. Moreover, a particulate component may be entrained with a lighter particulate component and the method be primarily directed to separation of the two sets of particles. Thus, in a particular aspect, the invention provides a method of separating lighter and heavier particles in a solids mixture, comprising:

entraining the mixture in a liquid of a specific gravity intermediate the specific gravities of the lighter and heavier particles;

feeding the liquid with entrained mixture into one end of a vessel and revolving the liquid therein, by rotating the vessel, the vessel being designed so that the liquid attains a dynamic equilibrium at which an annular, centrifugally induced, substantially static, revolving volume of the liquid of stable internal surface is confined by the vessel about the axis of revolution while further liquid flows on within said stable internal surface, whereby the heavier particles are centrifugally directed into said annular volume of the liquid while the lighter particles remain entrained in on-flowing liquid within said internal surface which flows out a second opening in the other end of the vessel; and discontinuing feeding the mixture to the vessel, slowing and stopping the rotating vessel to release said annular volume of the liquid, which then, with the heavier particles entrained, swirls towards and flows through one of said openings.

The method is advantageously applied where the heavier particles are in very low concentration in the mixture.

The method preferably comprises continuing to feed the liquid, without entrained mixture, through said first opening as the vessel slows and/or after it has stopped, to flush out any residual heavier particles remaining on the interior surface of the vessel. Moreover, liquid without entrained mixture may be fed through said first opening for a period before slowing said vessel, to flush out any residual lighter particles within or on said internal liquid surface.

The axis of revolution is preferably vertical or substantially inclined to the horizontal with the first opening uppermost. The on-flowing liquid within said internal surface will typically be a helically flowing stream itself defining an internal surface. Advantageously, the method of the invention further includes physically breaking the natural such surface over a region sufficient to submerge heavier particles thereon and thereby to encourage their movement to said annular volume of the liquid.

In a further aspect the invention provides centrifuge apparatus comprising:

a vessel having a pair of opposed openings;

bearing means to support the vessel for rotation about an axis which passes through or near said openings; and an annular space within said vessel between and laterally of said openings for retaining said centrifugally induced, substantially static, revolving volume of the liquid during performance of the method;

wherein, said vessel has a smooth continuous interior surface, free of negative slopes, edges or bends for a liquid droplet swirling towards said one opening, whereby sufficient swirling liquid is able to clean the whole of said smooth interior surface of heavier particles.

The vessel and bearing means are preferably so mounted that said axis is vertical or substantially inclined to the horizontal. Alternatively, if the vessel rotates about a horizontal or near-horizontal axis, it is preferable that it be mounted for selective movement to a greater inclination, most preferably vertical.

With the provision of the smooth continuous interior surface as described, surface tension effects will ensure that further liquid will wash down the inside surface of the vessel to remove any residual heavy particles, which will be observable, if the vessel is transparent, by virtue of the identifying bow wave.

Advantageously, the apparatus further includes a separation member within the vessel between said openings to facilitate the centrifugal action on the liquid feed, and for physically breaking the natural internal surface of the on-flowing liquid over a region sufficient to submerge heavy particles thereon and thereby to encourage their movement to said annular volume of the liquid.

It will be appreciated that, as with other prior classes of centrifuges, the apparatus may be employed to classify particulate material, e.g. by using a bank of vessels in series with different liquid/speed combinations.

The invention will be further described, by way of example only, with reference to the accompanying drawings, in which.

Figure 1:
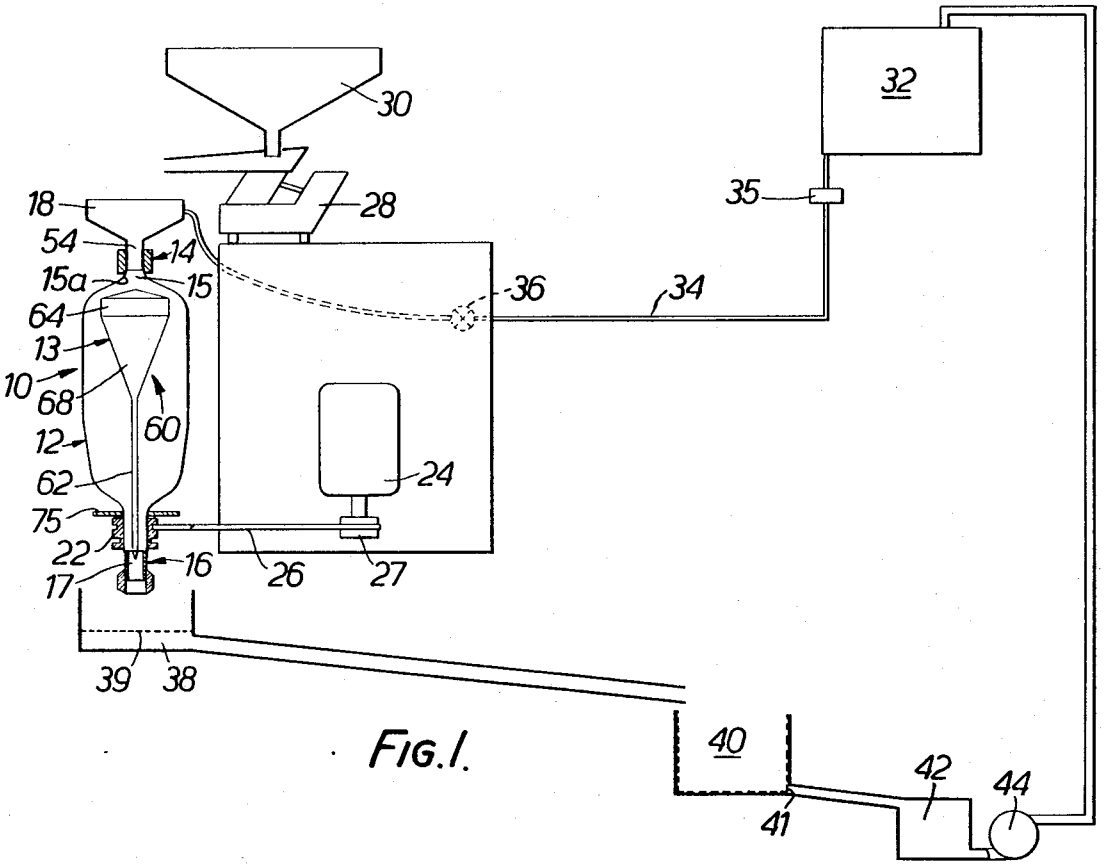
FIG. 1 is a schematic diagram depicting both centrifuge apparatus according to the invention and peripheral equipment employed with the apparatus where it is to be used for the separation of heavier and lighter particles in a solids mixture.
Figure 2:
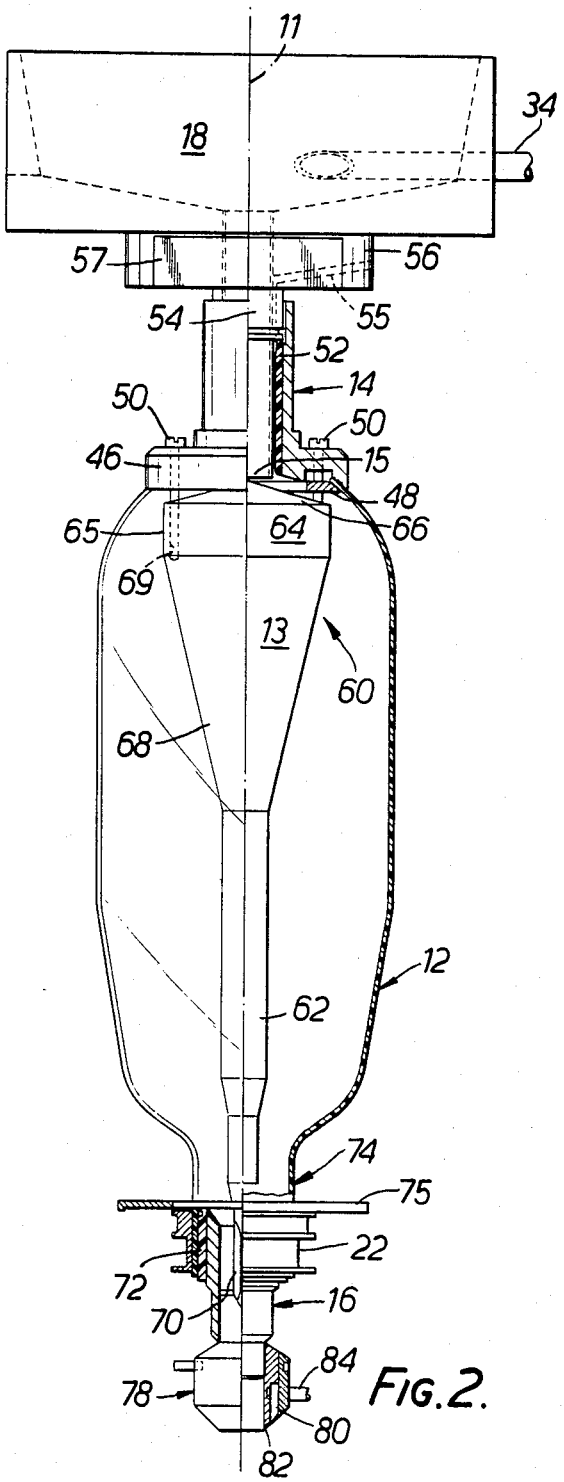
FIG. 2 is a side elevation/axial cross-section of the said centrifuge apparatus.

Refering firstly to FIG. 1, the centrifuge apparatus 10 includes a somewhat elongate, axially symmetrical vessel 12 supported when in use with its axis vertical in upper and lower bearings 14, 16. Respective opposed openings 15, 17 at the bearings respectively serve as an inlet opening 15 fed by a funnel 18 and as a discharge opening 17 through which contents of the vessel fall to an underlying receptacle 39. Bearing 16 carries a pair of drive pulleys 22 by which the vessel is rotated about its vertical axis in the bearings 14, 16 by an electric motor 24 via a drive belt 26. A separation member 13 is suspended within vessel 12, being fastened about inlet opening 15 and rotatably supported in lower bearing 16.

Peripheral equipment for performing the centrifugal solids separation process includes, in addition to motor 24 and belt drive 26, a vibratory solids feeder 28 which discharges a solids mixture to the funnel 18 at a controlled rate from a primary feed bin 30, and a heavy liquid source including a head tank 32 from which a liquid is supplied to the funnel 18 along tube 34 via filter 35 and valve 36. As will be explained, lighter particles are continuously discharged from opening 17, being entrained in on-flowing liquid. The contents of receptacle 38, which has a sieve 39, are directed to a bin 40 where the floats are collected and from where liquid is recovered through a 10-micron screen cloth 41 and returned to head tank 32 by pump 44 from a sump 42.

Vessel 12 is preferably transparent and may be of the general configuration of an upside down bottle, with an aperture in its base, as shown, or may be more like the shape of a conical separating funnel.

As will become apparent in due course, it is necessary that, for a substantial segment of the axis between openings 15, 17 the vessel is of greater internal cross-section than the openings with respect to the axis of the vessel: in the illustrated case, much of the vessel between the openings meets this requirement. The material of the vessel will preferably be impervious to and non-reactant with the chosen liquid. Stainless steel can be used but has the disadvantage of not being transparent (for the purpose of detecting residual particles, as will become apparent hereinafter). Glass may be used but appropriate safety measures need to be taken in case of accidental breakage. A typical heavy liquid is tetrabromoethane (TBE) for which a suitable vessel material is clear polyethylene terephthalate (PET).

It will also be noted that the interior surface of vessel 12 is smooth and continuous, being curved and shaped so that no droplet or particle travelling (i.e. swirling as will be appreciated hereinafter) from opening 15 to opening 17 is confronted with a negative slope, edge or bend. The upper rim 15*a* (FIG. 1) of opening 15 is also curved, although this is not readily apparent from all the drawings.

Opening 15 comprises a simple aperture through the vessel wall. The rim of the aperture is retained between a flange 46 on bearing 14 and an internal retaining ring 48 by three equiangularly spaced retaining screws 50. Screws 50 project through into separation member 13 to provide fastenings for the latter.

Bearing 14 has an internal low friction sleeve 52 which rotatably receives the depending outlet neck 54 of funnel 18. The main body of funnel 18 has an underlying boss 56 with side flats 57 by which the funnel is held against rotation in retaining arms (not shown) that project from an upright stand or housing such as motor housing 23 in FIG. 1. Heavy liquid supply tube 34 opens to the interior of funnel 18 substantially tangentially so that the liquid executes a helically swirling flow as it descends through the funnel and outlet neck 54. A curtain of the liquid is also introduced along sleeve 52 via capillary 55 for the twin purposes of lubricating the bearing and washing out particles which might otherwise cling about the lower end of neck 54.

Separation member 13 comprises a broadly bi-conical head 60 on an elongate co-axial stem 62. Head 60 is an integral solid having a short cylindrical portion 64 with peripheral surface 65, a shallow conical top 66, and an underlying truncated conical portion 68 which is bored to receive stem 62. Three screw holes 69 receive screws 50 for suspending the separation member below the retaining ring 48 so as to maintain a finite annular spacing.

The lower end of stem 62 is thinned to vaned tip 70 which sits freely in the bore of bearing 16. Bearing 16 carries an external flanged sleeve 72 of a low friction material which rotatably seats a depending neck 74 defining the discharge opening 17 of vessel 12. Firmly retained on the neck is a double pulley 22 with a pair of grooves of different diameters for selectively engaging belt 26 to effect rotation of the vessel preferably in a rotation sense opposite to that with which liquid swirls in funnel 18 from tube 34. The pair of grooves permit, in conjunction with a corresponding pair of pulleys 27 on the shaft of motor 24, a variation in rotational speed.

Neck 74 also mounts a slinger 75 above the pulley. This slinger has the dual function of (i) during rotation of the centrifuge, throwing off any excess liquid that has found its way onto and is dribbling down the outside of vessel 12, before the liquid gets to the pulley drive system, and (ii) facilitating easy manual rotation of the vessel during visual inspection.

The lower end of bearing 16 is held in a tapered sleeve 78 held against rotation by straps (not shown) attached to housing 23. Sleeve 78 has an internal annular cavity 80 with peripheral capillaries 82 and liquid supply tube 84 for applying a downwardly flowing curtain of the clean liquid to prevent any retention of grains in the region of the sleeve.

The operation of the apparatus in the centrifugal separation of heavier and lighter particles will now be described, with particular reference to FIGS. 3A to 3D.

Figure 3A:
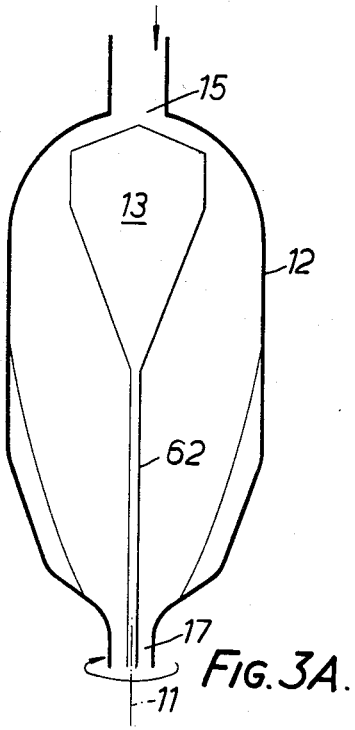
FIGS. 3A to 3D diagramatically indicate successive stages in the centrifugal separation process.
Figure 3B:
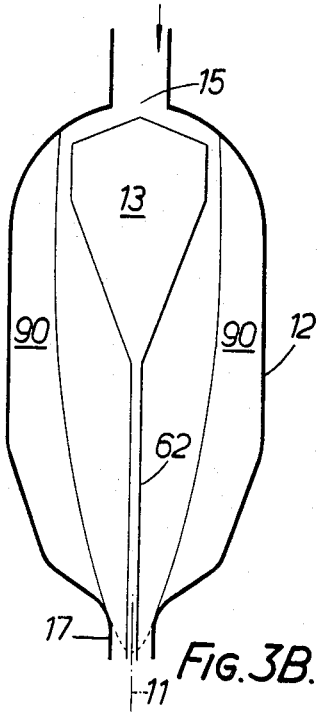
Figure 3C:
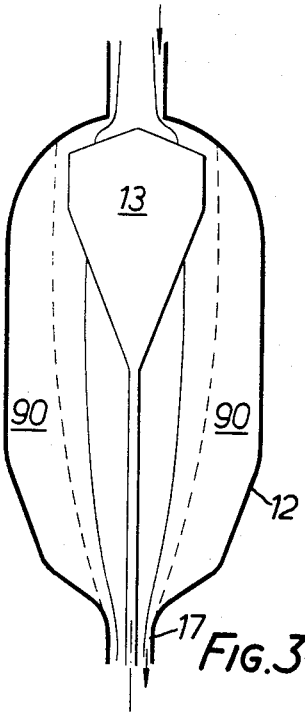
Figure 3D:
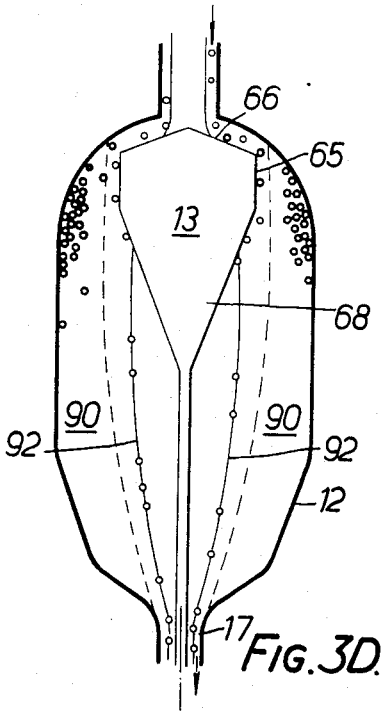

Vessel 12 is set into rotation about axis 11 and liquid, e.g. TBE, added gradually through tube 34, funnel 18 and opening 15. Centrifugal forces spread the revolving, helically descending liquid outwards until the liquid-air interface forms a truncated paraboloid of revolution (FIG. 3A). As further liquid is added, this interface gradually contracts until maximum retainable liquid is present in vessel 12 (FIG. 3B). The liquid has now attained a dynamic equilibrium at which an annular, centrifugally induced, substantially static revolving volume 90 of the liquid of stable internal surface is confined by the vessel about axis 11. Any further liquid added will flow freely helically downwardly within this volume and pass through discharge opening 17, as shown in FIG. 3C.

The solids mixture is now added to the in-coming liquid by being fed to funnel 18 by vibratory feeder 28. This mixing is assisted by the swirling action of the liquid in funnel 18, especially if the rotational sense of the swirling motion is opposite to the direction of rotation of the vessel. The entrained particles then flow down the neck 54 of funnel 18 on to the top 66 of separation member 13. A head of liquid forms which forces a steady outward flow over the conical surface of top 66 to the edge of the separation member. This edge forms a separation point at which the particles are subjected to an enhanced centrifugal force in comparison to the force on the particles in neck 54. The heavier particles are directed into the annular static volume 90 of the heavy liquid while the lighter particles are forced inwards onto the cylindrical surface 65 of the separation member 13. The current of excess liquid washes these lighter particles downwards and also releases any entrained heavier particles until the liquid air interface 92 under cone 68 is reached. From here the lighter particles float down on the surface of the out-flowing liquid until they pass out through the discharge opening 17 to receptacle 38. Separation member 13 is important in enhancing the separation by physically breaking the natural internal surface (air/liquid interface) of the on-flowing liquid, to submerge stray heavier particles on the interface and thereby to encourage their movement to the static annular volume 90 of the liquid where they are subject to higher g-forces.

When the whole original solids mixture sample has passed through the vessel 12, clean liquid flow is continued through funnel 18, receptacle 38 is removed, a filter funnel is placed under discharge opening 17 and rotation of the vessel is stopped. The vortex of static liquid in the vessel is thus released, swirls towards and flows through opening 17, both as the vessel slows to a stop and for some time thereafter, washing most of the sink paticles into the filter funnel. The few particles which may tend to remain in the vessel are easily washed out with the continued flow of the liquid. Because of the smooth continuous rounded design of the vessel including the rim 15*a* of opening 15, surface tension effects ensure that further liquid flows around the walls down the inside surface of the vessel, and sufficient swirling liquid is able to clean the whole of said smooth interior surface of heavier particles. The separation member 13 is easily washed by directing liquid down the centre of the feed funnel neck 34, or simply by inserting a glass tube down the funnel neck to displace liquid onto member 13. The transparency of the vessel allows easy visual checking on whether any particles remain in the vessel as such a particle is revealed by the disturbance, e.g. bow wave, it causes in the even flow of liquid over the vessel surface.

This ease with which all particles may be cleaned from vessel 12 and from separation member 13 renders the illustrated centrifuge apparatus especially applicable to analyses in which a very small detection limit is involved. Vessel 12 and separation member 13 are cleaned by gravitional flow and any convenient vessel may be employed to collect first the floats and then the sinks, a situation in marked contrast to various commercial bowl centrifuges which require removal of the bowl or a rubber liner for cleaning and which require a special outer container to catch the liquid and floats which are flung from the outlet rim.

In contrast to elutriators, cyclones and dynawhirlpools in which the size and shape of each particle, as much as the specific gravity, determines the result, it will be noted that the separation in the inventive process is dependant primarily on the specific gravity of the liquid used. The speed of revolution of vessel 12 is not critical since it is an open system, and the liquid-air interface will adjust itself for whatever revolutions and liquid throughput are in use. Finer particles do settle out lower down in the vessel, so that the design of the vessel may be varied to suit the particle size which is to be separated. In general, the design of the vessel could be modified for other applications. Where visual checking of the cleanliness of the apparatus is not required, the vessel can be made from a non-transparent plastic or metal. Such a choice of materials also facilitates easier or cheaper fabrication of larger versions of the centrifuge detailed here and allows much larger samples to be treated. A higher rotational speed also allows finer particle sizes to be treated.

An important advantage of the process and apparatus is that separation in a high standard analysis may be partically mechanised without compromising accuracy. The apparatus is semi-continuous in that the vessel does require emptying at regular intervals, but the arrangement is nevertheless particularly suited to laboratory situations involving smaller samples.

By way of example, the process and apparatus were utilized for the quartz removal stage of the analysis of stream sediment samples for kimberlitic indicator minerals. The heavy liquid chosen was tetrabromoethane (TBE), specific gravity 2.96, which is the traditional liquid for this separation. In the conventional separation process, 100 gm samples of the concentrate, which would typically weigh between 1 and 10 kgs, are introduced into separating funnels one at a time and left for approximately 2 minutes. Utilizing the inventive process, the vessel 12 was rotated at about 630 rpm. The TBE flow rate was set at 10.4 mls per second and the particle size range of the feed sample was 0.4 to 2.0 mm. The vessel 12 had a volume of 2 liters, resulting in a static TBE volume of 1475 mls. The maximum throughput attainable was 600 gms per minute of dry mineral or up to 15 samples, each of 5 kg, per 8-hour day. A recovery in excess of 99.9% was achieved with fine grains with a specific gravity of 3.2. It was observed that the volume of flowing TBE in vessel 12 was about 338 mls and the maximum sinks retention in the vessel, approximately 1000 gm.

As earlier foreshadowed, the principles of the invention may be utilised in the separation of a mixture of substantially immiscible liquids. In such case, the heavier liquid is centrifugally directed into the revolving static volume of the lighter liquid, whereby the on-flowing liquid is clarified or purified. This process has particular application to the recovery of objectionable immiscible liquid from industrial waste water.

We claim:

1. A method of separating lighter and heavier particles in a solids mixture, comprising:

entraining the mixture in a liquid of a specific gravity intermediate the specific gravities of the lighter and heavier particles;

feeding the liquid with entrained mixture through a first opening into one end of a vessel and revolving the liquid therein by rotating the vessel, the vessel being designed so that the liquid attains a dynamic equilibrium at which an annular, centrifugally induced, substantially static, revolving volume of the liquid of stable internal surface is confined by the vessel about the axis of revolution while further liquid flows on within said stable internal surface, whereby the heavier particles are centrifugally directed into said annular volume of the liquid while the lighter particles remain entrained in on-flowing liquid within said internal surface which flows out a second opening in the other end of the vessel; and discontinuing feeding the mixture to the vessel, slowing and stopping the rotating vessel to release said annular volume of the liquid, which then, with the heavier particles entrained, swirls towards and flows through one of said openings.

2. A method according to claim 1 wherein said axis is vertical or substantially inclined to the horizontal, with said first opening uppermost.

3. A method according to claim 1 in which the liquid fed through the first opening is a helically swirling flow.

4. A method according to claim 1 further comprising physically breaking the natural internal surface of the on-flowing liquid over a region sufficient to submerge heavier particles thereon and thereby to encourage their movement to said annular volume of the liquid.

5. A method according to claim 1 wherein said on-flowing liquid has an internal interface with air on which the lighter particles float towards and out through said second opening in the other end of the vessel.

6. A method according to claim 1 wherein the liquid is tetrabromoethane (TBE) and the vessel is of polyethylene terephthalate (PET).

7. A method according to claim 6 wherein the mixture comprises sediment and the heavier particles kimberlitic indicator minerals.

8. A method according to claim 1 further comprising continuing to feed the liquid, without entrained mixture, through said first opening as the vessel slows and/or after it has stopped, to flush out any residual heavier particles remaining on the interior surface of the vessel.

9. A method according to claim 8 further comprising continuing to feed the liquid, without entrained mixture, through said first opening for a period before slowing said vessel, to flush out any residual lighter particles within or on said internal liquid surface.

10. A method according to claim 8 comprising utilizing for said vessel a vessel with a smooth continuous interior surface, free of negative slopes, edges or bends for a liquid droplet swirling towards said one opening, whereby sufficient swirling liquid is able to clean the whole of said smooth interior surface of heavier particles.

11. A method according to claim 10 wherein said axis is vertical or substantially inclined to the horizontal, with said first opening uppermost.

12. A method according to claim 10 in which the liquid fed through the first opening is a helically swirling flow.

13. A method according to claim 12 in which said helically swirling flow revolves oppositely to the vessel.

14. A method according to claim 1 wherein the heavier particles are in very low concentration in the mixture.

15. A method according to claim 14 wherein said axis is vertical or substantially inclined to the horizontal, with said first opening uppermost.

16. A method according to claim 14 in which the liquid fed through the first opening is a helically swirling flow.

17. A method according to claim 14 wherein said on-flowing liquid has an internal interface with air on which the lighter particles float towards and out through said second opening in the other end of the vessel.

18. A method according to claim 14, further comprising physically breaking the natural internal surface of the on-flowing liquid over a region sufficient to submerge heavier particles thereon and thereby to encourage their movement to said annular volume of the liquid.

19. A method according to claim 14 wherein the liquid is tetrabromoethane (TBE) and the vessel is of polyethylene terephthalate (PET).

20. A method according to claim 19 wherein the mixture comprises sediment and the heavier particles kimberlitic indicator minerals.

21. A method according to claim 14 further comprising continuing to feed the liquid, without entrained mixture, through said first opening as the vessel slows and/or after it has stopped, to flush out any residual heavier particles remaining on the interior surface of the vessel.

22. A method according to claim 21 further comprising continuing to feed the liquid, without entrained mixture, through said first opening for a period before slowing said vessel, to flush out any residual lighter particles within or on said internal liquid surface.

23. A method according to claim 21 comprising utilizing for said vessel a vessel with a smooth continuous interior surface, free of negative slopes, edges or bends for a liquid droplet swirling towards said one opening, whereby sufficient swirling liquid is able to clean the whole of said smooth interior surface of heavier particles.

24. A method according to claim 23 wherein said axis is vertical or substantially inclined to the horizontal, with said first opening uppermost.

25. A method according to claim 23 in which the liquid fed through the first opening is a helically swirling flow.

26. A method according to claim 25 in which said helically swirling flow revolves oppositely to the vessel.

27. A method of separating out a component entrained in a liquid, comprising:

continuously feeding the liquid through a first opening into one end of a vessel and revolving the liquid therein by rotating the vessel, the vessel being designed so that the liquid attains a dynamic equilibrium at which an annular, centrifugally induced, substantially static, revolving volume of the liquid of stable internal surface is confined by the vessel about the axis of revolution while further liquid flows on within said stable internal surface, whereby the entrained component to be separated is centrifugally directed into said annular volume of the liquid while liquid substantially clarified of such component flows on within said internal surface and out a second opening in the other end of the vessel; and discontinuing said feeding of the liquid, slowing and stopping the rotating vessel to release said annular volume of the liquid, which then, with the entrained components, swirls towards and flows through one of said openings.

28. A method according to claim 27 comprising utilizing for said vessel a vessel with a smooth interior surface, free of negative slopes or edges for a liquid droplet swirling towards said one opening, whereby sufficient swirling liquid is able to clean the whole of said smooth interior surface of said component after release of said annular volume of the liquid.

29. A method according to claim 27 wherein said axis is vertical or substantially inclined to the horizontal, with said first opening uppermost.

30. Centrifuge apparatus for separating lighter and heavier particles of a solids mixture entrained in a liquid comprising:

a vessel having a pair of opposed openings;

bearing means for supporting the vessel for rotation about an axis which passes through or near said openings; and an annular space within said vessel between and laterally of said openings;

wherein said vessel has a smooth continuous interior surface, free of negative slopes, edges or bends for a liquid droplet swirling towards one of said openings whereby sufficient swirling liquid is able to clean the whole of said smooth interior surface of heavier particles.

31. Centrifuge apparatus according to claim 30 wherein the vessel and bearing means are so mounted that said axis is vertical or substantially inclined to the horizontal.

32. Centrifuge apparatus according to claim 30 wherein said vessel is substantially transparent, to facilitate observation of bow waves in the swirling liquid caused by residual heavier particles on the interior surface of the vessel.

33. Centrifuge apparatus according to claim 30 wherein the bearing means comprises respective bearings in the region of the two openings, one such bearing being associated with a suitable drive transmission by which the vessel may be rotated by external powered drive means.

34. Centrifuge apparatus according to claim 33 wherein one or both of said bearings include means to introduce a curtain of liquid for washing and/or lubrication purposes.

35. Centrifuge apparatus according to claim 30 further comprising a separation member within the vessel, which separation member is broadly biconical and rotates with the vessel about said axis.

36. Centrifuge apparatus according to claim 35 wherein said separation member is secured to the vessel about and adjacent to one of said openings and has a depending stem with peripherally spaced vanes by which it is rotatably supported within or adjacent to the other of said openings.

* * * * *